US005249932A

United States Patent [19]

Van Bork

[11] Patent Number: 5,249,932

[45] Date of Patent: Oct. 5, 1993

[54] APPARATUS FOR CONTROLLING DIAPHRAGM EXTENSION IN A DIAPHRAGM METERING PUMP

[76] Inventor: Erik Van Bork, 609 Cheese Factory Rd., Honeoye Falls, N.Y. 14472

[21] Appl. No.: 771,477

[22] Filed: Oct. 7, 1991

[51] Int. Cl.[5] ..... F04B 9/08

[52] U.S. Cl. ..... 417/386; 417/385; 417/63

[58] Field of Search ..... 417/386, 385, 383, 388, 417/63; 92/5 R

[56] References Cited

U.S. PATENT DOCUMENTS

| | | | |
|---|---|---|---|
| 3,303,755 | 2/1967 | Linker | 92/5 R |
| 3,605,566 | 9/1971 | Vetter | 417/63 |
| 3,680,981 | 8/1972 | Wagner | 417/388 |
| 3,743,444 | 7/1973 | Kazama et al. | 417/92 |
| 3,985,467 | 10/1976 | Lefferson | 417/20 |
| 4,192,223 | 3/1980 | Lombard | 92/5 R |
| 4,315,523 | 2/1982 | Mahawili et al. | 137/486 |
| 4,343,597 | 8/1982 | Brown | 417/417 |
| 4,474,540 | 10/1984 | Bonastia et al. | 417/63 |
| 4,619,589 | 10/1986 | Muller et al. | 417/388 |
| 4,702,674 | 10/1987 | Fontaine et al. | 417/44 |
| 4,778,353 | 10/1988 | Wiernicki | 417/417 |
| 4,828,464 | 5/1989 | Maier et al. | 417/388 |
| 4,915,017 | 4/1990 | Perlov | 92/5 R |
| 4,966,528 | 10/1990 | Henkel et al. | 417/395 |
| 5,056,036 | 10/1991 | Van Bork | 364/510 |
| 5,074,755 | 12/1991 | Vincent | 417/383 |
| 5,081,450 | 1/1992 | Lucas et al. | 340/728 |

OTHER PUBLICATIONS

Metering Pump Handbook, McCabe et al.

*Primary Examiner*—Richard A. Bertsch
*Assistant Examiner*—Peter Korytnyk
*Attorney, Agent, or Firm*—Pollock, Vande Sande & Priddy

[57] ABSTRACT

A diaphragm metering pump having control over diaphragm extension is described. A position sensor is incorporated in a diaphragm metering pump to indicate the relative position of the diaphragm during flexure. When excessive extension of the diaphragm is sensed by the position sensor, a control valve will provide hydraulic fluid from a reservoir for inhibiting further deflection of the diaphragm in the direction in which it was moving. Diaphragm life is extended as well as the accuracy of metering provided by the pump maintained.

20 Claims, 4 Drawing Sheets

APPARATUS FOR CONTROLLING DIAPHRAGM EXTENSION IN A DIAPHRAGM METERING PUMP

RELATED APPLICATIONS

This application is related to U.S. Ser. No. 07/424,443 filed Oct. 20, 1989, now U.S. Pat. No. 5,056,036.

BACKGROUND OF THE INVENTION

The present invention relates to diaphragm metering pumps. Specifically, an apparatus for monitoring and controlling the extension of a diaphragm being actuated via a hydraulic fluid in a metering pump is described.

Metering pumps find diverse uses in many industrial processes. Diaphragm metering pumps operate from flexure of a flexible diaphragm which applies pressure to a pumped media, forcing the media through an outlet check valve. Reduction of the hydraulic pressure against the diaphragm returning to its preflexed state results in the diaphragm creating a pressure differential between the pumping chamber and pumping media inlet. A second valve permits additional pumping media to fill the pumping chamber.

The different applications for these metering pumps require diaphragms as diverse as stainless steel and Teflon. A major source of failure for metering pumps of this type results when the diaphragm ruptures, through excessive flexure and overextension. The overextension of a diaphragm results when the hydraulic force applied to the diaphragm either pushes or pulls it beyond material specific flexural limits.

Limitations against overextension of the diaphragms in either direction are provided by first and second dish plates in the hydraulic fluid chamber and pumping chamber. An overextension condition will occur as a result of a hydraulic imbalance as can be caused by leakage of hydraulic fluid past the piston. During retraction of the piston, which produces the hydraulic force for actuating the diaphragm, the diaphragm retracts against the rear dish plate before achieving an overextended state. Likewise, when the diaphragm is in the forward extended position during forward extension of the piston, a forwardly located dish plate retains the diaphragm from achieving an overextended state. Contact of the diaphragm with the dish plate can result in excessive stress levels and can contribute to premature diaphragm failure and is therefore, undesirable.

The subject of monitoring diaphragm failure has been described in several prior art patents. In U.S. Pat. No. 4,781,535 to Mearns, a leak detector was provided which essentially detected the occurrence of a rupture in the diaphragm after the fact. Although this technique minimizes the amount of contamination which results from hydraulic fluid mixing with pumped media and otherwise signals corrective action at the earliest possible time, it does not control diaphragm deflection to be certain that the deflection is within safe limits to avoid the possibility of a rupture and to prolong the life of a diaphragm.

The sensing of diaphragm position has been considered in U.S. Pat. Nos. 4,619,589 and 4,828,464. In these devices, the position of the diaphragm is monitored in an effort to precisely control the amount of fluid being pumped. The problem of overextension of the diaphragm in both directions, however, has not been completely addressed by the prior art. Experience has shown that the rearward dish plate will cause extrusion of some diaphragm materials such as Teflon when the diaphragm is drawn against the porous dish plate when the piston is retracted. Further, cavitation has been experienced wherein an air interface occurs between the diaphragm and hydraulic fluid in some extreme circumstances, due to the dish plate inhibiting further rearward movement of the diaphragm. The cavitation effect reduces the metering accuracy of the pump and is otherwise undesirable.

Given the foregoing difficulties of maintaining metering pump reliability, the present invention has been provided.

SUMMARY OF THE INVENTION

It is an object of this invention to accurately control deflection of a metering pump diaphragm.

It is a more specific object of this invention to continuously monitor diaphragm position and control hydraulic pressure against the diaphragm based on the position.

In accordance with the invention, a diaphragm position indicator is incorporated in a metering pump for detecting when a diaphragm has reached an overextended position. The hydraulic pressurizing fluid of the metering pump is connected via a solenoid-operated valve to a reservoir of intermediate pressurizing fluid. A control circuit connected to the diaphragm position sensor determines when the diaphragm deflection exceeds a maximum safe displacement. At such time, the control circuit will energize the solenoid-operated valve, venting the pressurizing chamber to the reservoir of intermediate pressurizing fluid. The result of venting the pressurizing chamber immediately inhibits further extension of the diaphragm.

Overextension of the diaphragm can occur either during the pressurizing stroke, when the piston advances, or during a pressure reduction which occurs when the piston retracts and pumping media is forced into the pumping chamber. During retraction of the piston, further extension of the diaphragm is prevented by operating the solenoid operated valve, connecting the pressure chamber to the reservoir, permitting a reverse flow of pressurizing fluid from the reservoir to the pressure chamber. When the pressurizing stroke of the diaphragm metering pump begins, the hydraulic fluid will be inhibited from flowing back through the solenoid-operated valve to the reservoir. Pressurizing of the diaphragm will then continue such that the diaphragm moves forward, pressurizing the pumping chamber and displacing pumped media. The diaphragm position sensor will generate a signal to close the valve once the diaphragm has moved forward into a region of safe displacement.

The invention may be implemented to prevent diaphragm over extension during the pressurizing stroke. When the diaphragm position is detected to have reached a second maximum displacement, a second valve means is operated connecting the pressurizing chamber to the intermediate reservoir. This will effectively terminate further diaphragm expansion. As the pressure is reduced due to the operation of the valve means, the diaphragm returns to a safe displacement. The new diaphragm position is detected, closing the second solenoid valve means.

By controlling the effective diaphragm displacement, it is possible to avoid overflexing of the diaphragm, thereby prolonging the life of the diaphragm and the need for any replacement. Controlling the deflection of the diaphragm will result in a predictable life expectancy for the diaphragm, permitting its replacement to be made before catastrophic failure occurs.

DESCRIPTION OF THE PREFERRED EMBODIMENT

Figure 1:
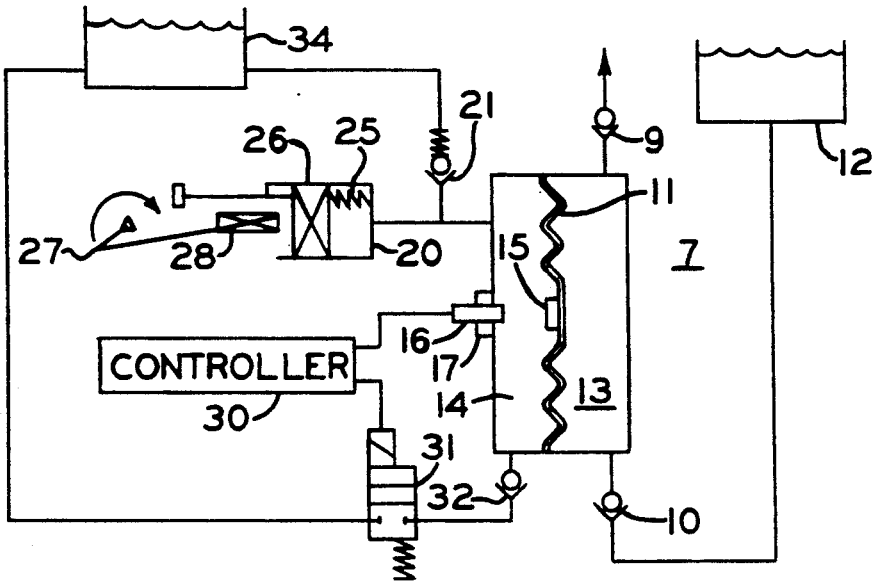
FIG. 1 is a schematic illustration of an embodiment of the invention for controlling diaphragm displacement.

Referring now to FIG. 1, there is shown a schematic representation of a metering pump 7 connected to a pumped media reservoir 12. A check valve 10 on the inlet of the diaphragm pump 7 and check valve 9 on the outlet of the diaphragm pump 7 permit the pumped media to enter and leave the pumping chamber 13 under pressure from the diaphragm 11.

Opposite the pumping chamber 13 is a hydraulic fluid chamber 14 which pressurizes the diaphragm 11 during a pumping stroke and creates a partial vacuum within the pumping chamber 13 during an intake stroke. The flexure of the diaphragm 11 is sensed by a sensor 16 facing a magnet 15 fixed to the diaphragm 11. Thus, motion of the diaphragm 11 may be effectively monitored by the proximity sensor 16. The sensor 16 may be positioned by a positioning member 17 to maintain the sensor 16 at the preferred distance from the magnet 15.

Pressurizing of the hydraulic pressure chamber 14 is accomplished via a piston 26 operating within cylinder 20. A reciprocating crosshead 28 will position the piston 26 to pressurize the chamber 14 and in a reverse motion, spring 25 will return the piston to its starting position as the crosshead 28 is retracted. The entire assembly is driven by a crank 27.

A pressure relief check valve is shown in the hydraulic circuit connecting the piston cylinder 20 to the hydraulic pressurizing chamber 14. The check valve 21 serves as a pressure relief valve such that an excessive amount of pressure causing excessive deformation of the diaphragm 11 and damage to the drive mechanism 42 would be avoided. The intermediate media reservoir 34 receives the hydraulic fluid passed by the pressure relief valve 21.

There is a solenoid-operated valve 31 connected via a check valve 32 to the hydraulic pressurizing chamber 14. When the diaphragm 11 is detected as having moved rearwardly to a position where it will be overextended, controller 30 will supply an operating signal to the solenoid-operated valve 31. Valve 31 opens, permitting the intermediate media hydraulic fluid from reservoir 34 to enter the hydraulic pressurizing chamber 14. This will inhibit further movement of the diaphragm 11 toward the sensor 16.

Thus, the diaphragm 11 will remain in its sensed position until the piston 26 pressurizes the hydraulic pressure chamber 14, closing check valve 32.

FIGS. 2A, 2B, 2C and 2D illustrate the operation of the device of FIG. 1. As is shown, the crosshead displacement varies from a reference line of 0% to 100% forward, and then back to 0%, cyclically. Due to the lost motion coupling between the piston 26 and crosshead 28, the piston position advances when the crosshead moves from 50% of its stroke length to 100% stroke length—dependent on the current mechanical stroke adjustment setting.

Figure 2A:
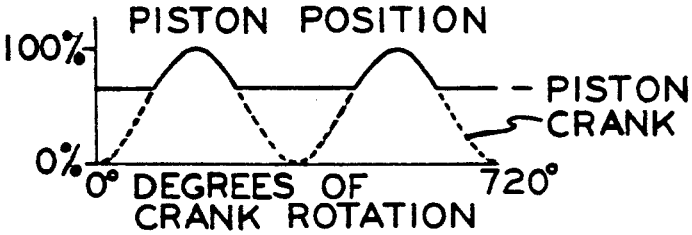
FIG. 2A illustrates the piston position versus crank position for the metering pump of FIG. 1.
Figure 2B:
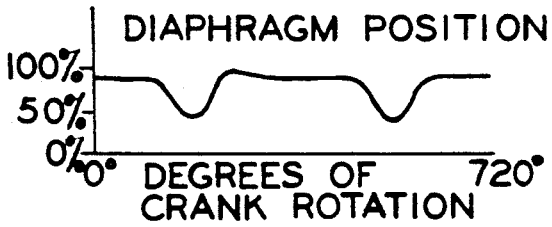
FIG. 2B illustrates the relationship of actual diaphragm position to the crank position.
Figure 2C:
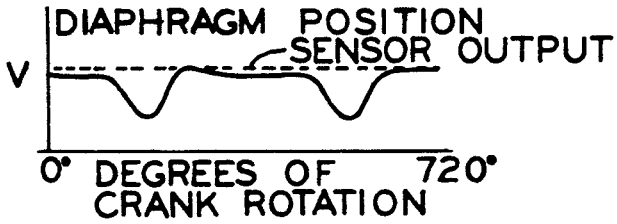
FIG. 2C illustrates the sensor output signal in relationship to the crank position.
Figure 2D:
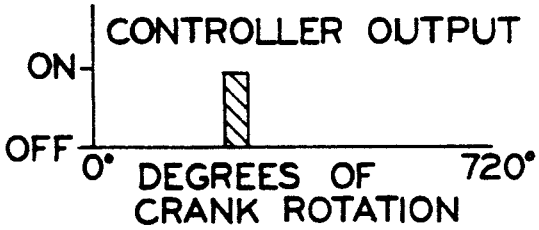
FIG. 2D illustrates the control signal applied to the solenoid-operated valve for limiting displacement of the diaphragm.

The diaphragm position 2B can be shown in response to motion of the piston 26. The scale on the y-axis of FIG. 2B is shown in units of percentage of diaphragm displacement where the 100% value is indicative of the diaphragm attached magnet 15 in close proximity to the sensor 16. When the diaphragm is being retracted from a forward position rearwardly, where it would normally be stopped by a rearwardly located dish plate, the controller 30 will activate valve 31. This position is illustrated in FIG. 2C as a dotted line, and the resulting control signal is shown in FIG. 2D. The diaphragm position which will result in operation of solenoid valve 31 is experimentally determined and specified to the controller 30 such that the diaphragm 11 is not overflexed. This position is represented by the dotted line in FIG. 2C and is dependent on the material type and other considerations known to those skilled in the art.

Figure 3B:
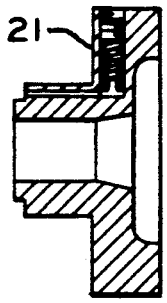
FIG. 3B illustrates detail A of FIG. 3A which provides an overpressure bypass to the hydraulic fluid chamber.
Figure 3A:
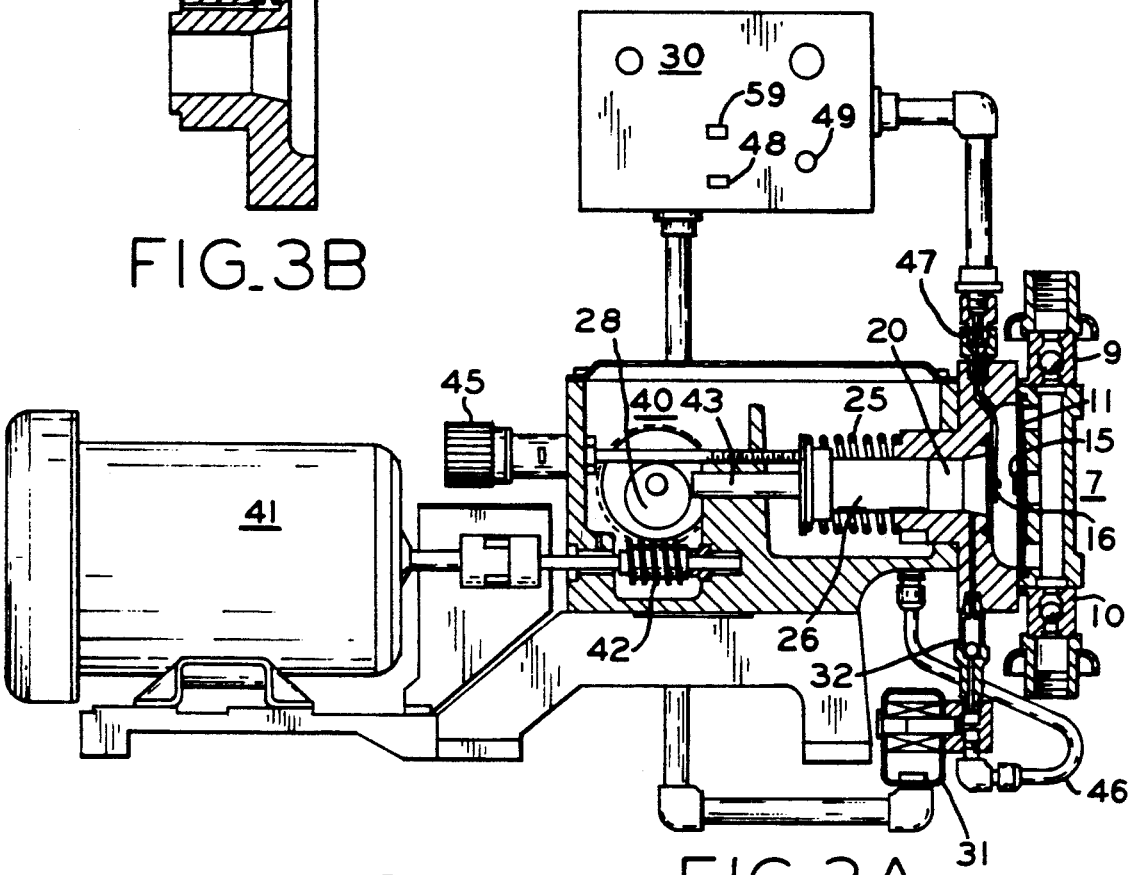
FIG. 3A is a cross-section of a metering diaphragm pump of the apparatus schematically shown in FIG. 1.

With respect to FIGS. 1 and 2A–2D, the general operation of the preferred embodiment has been described. A practical embodiment of the foregoing system design is shown in FIGS. 3A and 3B. FIG. 3A is a section-view of a diaphragm metering pump employing the system of FIG. 1 for limiting diaphragm deflection. Detail "A", shown in FIG. 3B shows the hydraulic pressure relief valve 21, positioned to be in communication with piston cylinder 20. The embodiment of FIG. 3A provides for an intermediate media reservoir 40 which surrounds the pump piston 26. The motor drive 41 and gear structure 42 is used to drive the cam 28 to reciprocate the piston 26 via the cam follower 43, also known as a cross-head. A stroke adjustment 45 is provided which will limit the rearward travel of the piston 26 when pushed rearwardly by spring 25. These structural details regarding the driving of the mechanism for the piston 26 are conventional in metering pump design, and will not be further described.

The solenoid valve 31 is shown connected via the conduit 46 to the internal intermediate hydraulic fluid reservoir 40. Check valve 32 connects hydraulic inlet of solenoid valve 31 to the piston chamber 20.

The magnet 15 is mounted to the diaphragm 11 and is sensed by the sensor 16 supported at the outlet of the piston cylinder 20. Sensor 16 may be a Hall proximity transducer device which detects the magnetic field of magnet 15 and which provides a current proportional to the distance between the magnet 15 and the sensor 16. Electrical connections 47 from the sensor are connected to the controller 30. In the preferred embodiment, the controller 30 includes a pair of light indicators 59 and 48 to show the status of solenoid valve 31 as being either open or closed. Further, a threshold adjustment 49 permits the position threshold at which the solenoid valve 31 will be open to be manually adjusted. Thus, for various diaphragms, one may set the threshold at a greater or lesser value, depending on the limits of deflection sought to be imposed on the diaphragm 11. The adjustment of the threshold voltage can be facilitated by using a voltage metering device across resistor 51. Thus, as shown in FIGS. 3A and 3B, the foregoing preferred embodiment may be implemented in a conventional metering pump design.

Figure 4:
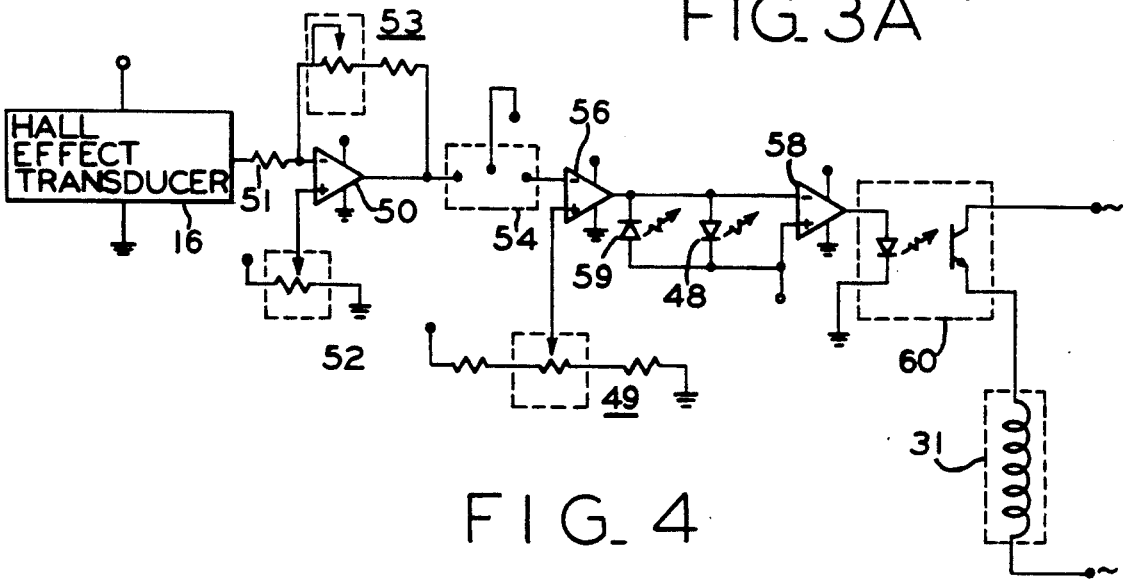
FIG. 4 is a schematic drawing of the control circuit for generating the solenoid valve operating signal

The controller 30 is illustrated in greater detail in the schematic drawing of FIG. 4. Referring now to FIG. 4, the control circuit can be seen to include a first operation amplifier 50 connected via a series resistor 51 to receive a signal from the Hall effect transducer 16. An internal offset control 52 causes amplifier 50 to offset the output signal. A conventional internal gain control 53 is also shown for setting at the factory an appropriate gain setting for amplifier 50. Those skilled in the art will also recognize it possible to provide a volt meter connected to the output of amplifier 5 to monitor the diaphragm position.

Switch 54 is shown for connecting either the output of the amplifier, a 10 volt reference level, or a floating reference level to the input of comparator 56. Selection causes the valve to operate in the automatic, forced open or forced closed states. The threshold adjustment control 49 comprises a potentiometer connected in series with two limiting resistors. The output of comparator 56 will change when the Hall effect transducer produces a signal on the input of comparator 56 greater than the signal provided by the threshold adjustment potentiometer 49. The two states provided by comparator 56 represent either the valve open or valve closed condition, depending on the proximity of magnet to sensor 16.

Indicators 59 and 48 are conventional LED diodes, responsive to the signal produced by the comparator 56. Comparator 58 conditions the signal to the opto-isolators as required by the solenoid valve. Thus, it can be seen that the controller for the embodiment of FIG. 3A can be constructed of standard electronic components which will provide for an indication of the current operating condition of the solenoid valve, thus illustrating whether or not an overextension condition is being imposed on the diaphragm 11.

The foregoing description is illustrative of only one embodiment of several which may be implemented to avoid overextension of the diaphragm 11. The example illustrates diaphragm overextension in the context that diaphragm 11 and attached magnet 15 are in close proximity to sensor 16. This same system may be used to protect diaphragm 11 from overextension in the opposite direction—when diaphragm 11 is furthest away from sensor 16. This can be accomplished by simply reversing the input to comparator 56 shown in FIG. 4 and reversing the stop direction of check valve 32 shown in FIG. 3A. Such a configuration would prevent the overextension of the diaphragm into the pumped media chamber. Additionally, both protection mechanisms can be applied simultaneously.

Figure 5:
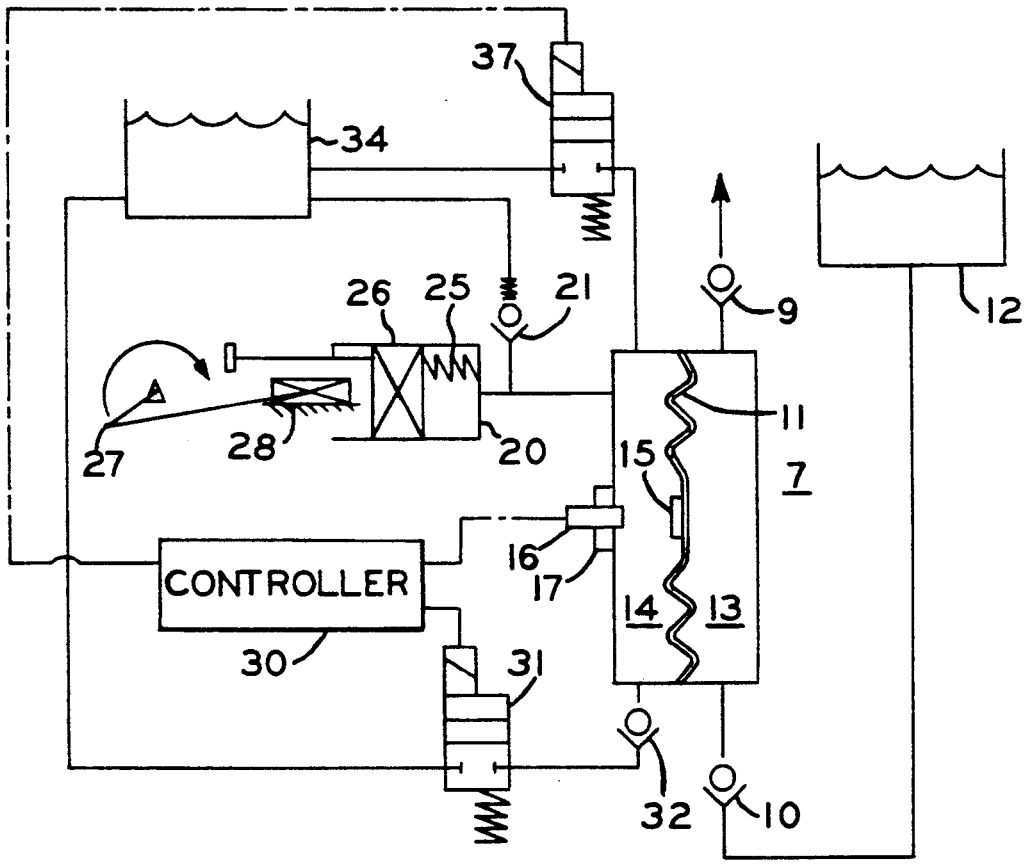
FIG. 5 illustrates another embodiment of the invention for controlling diaphragm deflection in two directions.
Figure 6A:
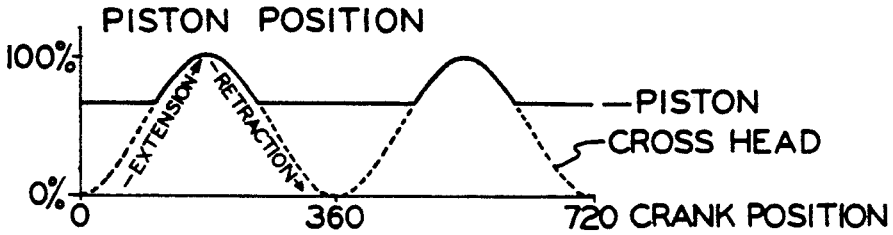
FIG. 6A illustrates the piston position vis a vis crosshead position for the diaphragm pump of FIG. 5.
Figure 6B:
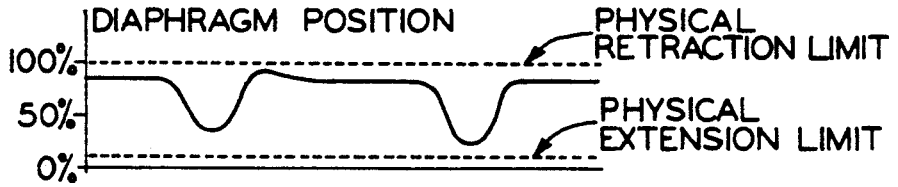
FIG. 6B illustrates the sensed diaphragm position during the pumping operation.
Figure 6C:
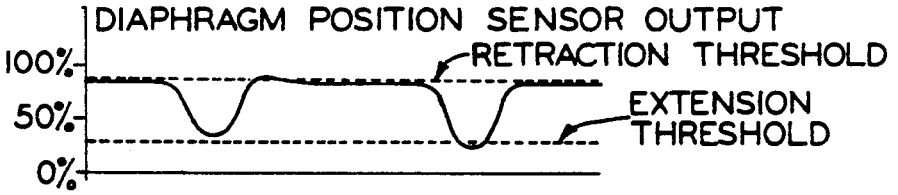
FIG. 6C illustrates the diaphragm position sensor output with respect to a retraction threshold and extension threshold.
Figure 6D:
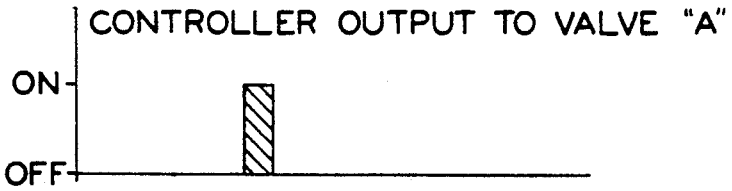
FIG. 6D illustrates the controller output to the solenoid valve 36.
Figure 6E:
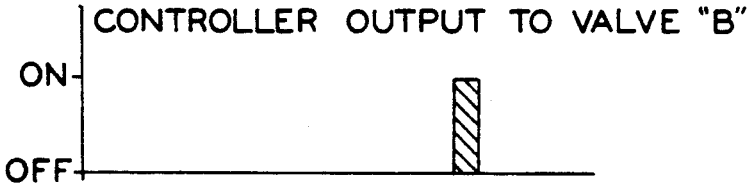
FIG. 6E illustrates the output to the solenoid valve 37.

FIG. 5 illustrates an embodiment in which the diaphragm 11 is protected from overextension during the pressurizing stroke. The sensor 16 is capable of providing an indication of when the diaphragm 11 exceeds an extension threshold. The controller 30, upon sensing the diaphragm position beyond the extension threshold, will issue a signal as shown in FIG. 6E to control solenoid valve 37. Valve 21, as in the previous embodiment, provides a failsafe relief valve in the event an excess amount of pressure occurs which is not relieved by valve 37.

In this embodiment, further pressurizing of chamber 14 ceases as the pressure is vented back to the intermediate reservoir when the extension threshold has been met. The appropriate operation then for the diaphragm is shown in FIG. 6B, wherein the diaphragm position is maintained within a retraction limit and extension limit to avoid overstressing of the diaphragm in two directions of flexure. During retraction, the embodiment of FIG. 5 works as the embodiment of FIG. 1, such that a signal is applied from controller 30 to the solenoid-operated valve 31, thus limiting the extension of the diaphragm during retraction of the piston.

Although not illustrated in FIG. 3A, the conventional dish plate structure, which normally inhibits rearward movement of the diaphragm 11 may continue to be used as a secondary backup means for checking overextension of the diaphragm 11 during the intake cycle of the diaphragm pump.

The foregoing embodiments are not limited to a particular type of diaphragm material 11 but may be used on diaphragms of all types with suitable changes in the threshold implemented, presenting the maximum safe displacement of diaphragm 11. Additionally, it is not limited to a particular means of adjusting the pump displacement. Those skilled in the art will recognize yet other embodiments as described by the claims which follow.

What is claimed is:

1. An apparatus for inhibiting over extension of a diaphragm of a metering pump comprising:

a diaphragm position, sensor for detecting when a diaphragm is being over extended during an intake stroke of said metering pump;

a reservoir of intermediate pressurizing fluid;

valve means connecting said intermediate pressurizing fluid to one side of a diaphragm chamber of said metering pump, said valve means supplying in response to a control signal replenishment pressurizing fluid to said diaphragm chamber;

control circuit means connected to said diaphragm position sensor for determining when, said diaphragm deflection exceeds a maximum safe displacement during an intake stroke of said pump, said control circuit means supplying said control signal to said valve means for enabling flow of said replenishment pressurizing fluid; and, means for inhibiting reverse flow of said replenishment pressurizing fluid through said valve means.

2. The apparatus of claim 1 wherein said position sensor comprises:

a permanent magnet attached to said diaphragm which moves with said diaphragm; and, magnetic field detector means supported on a wall of said diaphragm chamber, facing said magnet, for providing an electrical current proportional to said magnet position.

3. The apparatus of claim 2 wherein said magnet is attached to said diaphragm on a side of said diaphragm which is in contact with said intermediate pressurizing fluid.

4. The apparatus of claim 2 wherein a current metering device displays the output of the diaphragm position sensor indicative of diaphragm position.

5. The apparatus of claim 1 wherein said means for preventing reverse flow of said pressurizing fluid is a check valve connected between said valve means and diaphragm chamber.

6. The apparatus of claim 1 wherein said valve means supplies a relief of pressurizing fluid from said diaphragm chamber to said reservoir including means for inhibiting reverse flow through said valve means during an exhaust stroke.

7. The apparatus of claim 6 wherein said pressure relieve valve includes a check valve for providing unidirectional flow of pressurizing fluid between said diaphragm chamber and reservoir.

8. The apparatus of claim 1 wherein said control circuit means comprises:

a comparator circuit receiving on a user-supplied first input a threshold voltage representing a diaphragm position and receiving on a second input a signal from said sensor representing said diaphragm instantaneous position;

a relay connected to said comparator circuit and to said valve means, said relay energizing said valve means in response to said comparator providing a signal indicating said diaphragm position has reached a maximum safe displacement.

9. The apparatus of claim 1 further comprising a pressure relief valve connected between said diaphragm chamber and said intermediate reservoir for venting said chamber to said reservoir when said intermediate pressurizing fluid produces excessive fluid pressure in said diaphragm chamber.

10. In a diaphragm metering pump having a diaphragm separating a pumping chamber from a pressurizing chamber, an apparatus for limiting deflection of said diaphragm in response to changes in pressure in said pressurizing chamber comprising:

a first valve means connecting said pressurizing chamber to a reservoir of pressurizing media, said valve means operating in response to an excessive pressure condition to vent said pressurizing media to said reservoir, thereby inhibiting further deflection of said diaphragm when said diaphragm reaches a first extreme position;

a second electronic valve means connecting said pressurizing chamber to said reservoir;

diaphragm position sensing means for providing a signal representing the position of said diaphragm; and, circuit means connected to receive said signal, and to operate said electronic valve means when said diaphragm reaches a second extreme position in response to a decrease in said media pressure, whereby further deflection of said diaphragm is inhibited.

11. The apparatus of claim 10 wherein said first and second valve means permit a unidirectional flow of media from and to said pressurizing chamber.

12. The apparatus of claim 10 wherein said diaphragm position sensing means includes a permanent magnet affixed to said diaphragm, and a sensor disposed in said pressurizing chamber for sensing the relative position of said magnet.

13. In a diaphragm metering pump having a diaphragm separating a pumping chamber from a pressurizing chamber, an apparatus for limiting deflection of said diaphragm in response to changes in pressure in said pressurizing chamber comprising:

a first valve means connecting said pressurizing chamber to a reservoir of pressurizing media, said valve means operating in response to an excessive low pressure condition to vent said pressurizing media to said pressurizing chamber, thereby inhibiting further deflection of said diaphragm when said diaphragm reaches a first extreme position:

a second electronic valve means connecting said pressurizing chamber to said reservoir;

diaphragm position sensing means for providing a signal representing the position of said diaphragm; and, circuit means connected to receive said signal, and to operate said electronic valve means when said diaphragm reaches a second extreme position in response to an increase in said media pressure, whereby further deflection of said diaphragm is inhibited.

14. The apparatus of claim 13 wherein said diaphragm position sensing means includes a permanent magnet affixed to said diaphragm, and a sensor disposed in said pressurizing chamber for sensing the relative position of said magnet.

15. The apparatus of claim 13 wherein said electronic valve means includes a check valve connected between said electronic valve means and diaphragm chamber as to prevent reverse flow of said pressurizing fluid.

16. The apparatus of claim 13 wherein a current metering device displays the output of the diaphragm position sensor indicative of diaphragm position.

17. In a diaphragm metering pump having a diaphragm separating a pumping chamber from a pressurizing chamber, an apparatus for limiting deflection of said diaphragm in response to changes in pressure in said pressurizing chamber comprising:

a first mechanical valve means connecting said pressurizing chamber to a reservoir of pressurizing media, said valve means operating in response to an excessive pressure condition to vent said pressurizing media to said reservoir, thereby inhibiting further deflection of said diaphragm when said diaphragm reaches a first extreme position;

a first and second electronic valve means connecting said pressurizing chamber to said reservoir;

diaphragm position sensing means for providing a signal representing the position of said diaphragm; and, circuit means connected to receive said signal, and to operate said first electronic valve means when said diaphragm reaches a second extreme position in response to an increase in said media pressure, and to operate said second electronic valve means when said diaphragm reaches a third extreme position in response to a decrease in said media pressure, whereby further deflection of said diaphragm is limited to said range as defined by diaphragm response to said pressure extremes.

18. The apparatus of claim 17 wherein said diaphragm position sensing means includes a permanent magnet affixed to said diaphragm, and a sensor disposed in said pressurizing chamber for sensing the relative position of said magnet.

19. The apparatus of claim 17 wherein said second electronic valve means includes a check valve connected between said electronic valve means and diaphragm chamber as to prevent reverse flow of said pressurizing fluid.

20. The apparatus of claim 17 wherein a current metering device displays the output of the diaphragm position sensor indicative of diaphragm position.

* * * * *